US005511622A

United States Patent [19]

Thompson

[11] Patent Number: 5,511,622

[45] Date of Patent: Apr. 30, 1996

[54] FIRE PORT VALVE

[76] Inventor: David M. Thompson, 802 Mantoloking Rd., Brick Town, N.J. 08723

[21] Appl. No.: 283,638

[22] Filed: Aug. 1, 1994

[51] Int. Cl.[6] ..... A62C 39/00

[52] U.S. Cl. ..... 169/70; 169/62; 52/220.8

[58] Field of Search ..... 169/70, 62; 239/271; 220/254, 307; 49/171; 52/220.8; 285/901; 137/855; 251/149.2; 138/89.3, 94, 94.5

[56] References Cited

U.S. PATENT DOCUMENTS 4,047,572 9/1977 Stary et al. ..... 169/70 X 5,036,924 8/1991 Carino ..... 169/70

*Primary Examiner*—Andrew C. Pike

*Attorney, Agent, or Firm*—Charles F. Gunderson

[57] ABSTRACT

A small hollow device extends through the wall of an engine compartment or box. It can be secured to the box by a flange around its outside edge attached to the wall of the engine box. A stop or valve, in the shape of the hollow device, is fitted into the hollow portion of the device, and may be held by another flange inside the wall of the box, to seal it in normal operation. However, this stop is secured within the hollow portion of the device by a flexible coupling that holds the stop in place in normal operation, but allows it to move to an open position when the nozzle of a fire extinguisher is pushed against it. This permits a fire within the engine box to be extinguished quickly and safely without the necessity of opening the lids of the box, which would admit large quantities of air to feed the combustion and flames.

1 Claim, 1 Drawing Sheet

FIRE PORT VALVE

BACKGROUND OF THE INVENTION

The danger of fire at sea is very real, and very many design concepts are intended to minimize this, and very many steps are taken to avoid this. The engine and its fuel supply are, of course, the elements on a modern power boat that are the greatest fire hazard, because of the heat generated by the engine, and the combustable fuel. They are almost always contained in an engine compartment, box, or cover, to protect boaters.

Other steps must be taken for safety. The engine box or compartment must be cleared of any possible vapors before the engine is started, and all hands must be standing by until the engine is running smoothly. Serviceable fire extinguishers must be in place at all times near the engine compartment, which is one of several safety requirements.

However, it is still possible for the engine to overheat. This may be caused by a clogged or inadequate cooling system; exceptionally hot weather; malfunction or overload of the engine; or just poor design. Such overheating can start fires in the confined engine compartment, which may spread to the rest of the ship if not contained. Leaks or breaks in the fuel supply are even more serious, and add to the hazard.

All engine compartments must be provided with a lid or lids to have access to the engine and all of its components for servicing or replacement. However, this is, normally, the only access to the engine. In the event of a fire in the engine compartment, it is suddenly necessary to find and actuate the nearest fire extinguisher, and to open the large lid to spray its special chemicals onto the burning components of the engine and its housing.

Such fires are inevitably fed by engine fuel or lubricating oil, which are extremely volatile and dangerous. The only thing that contains the fire, momentarily, is the lack of oxygen. However, the necessary opening of the lid to discover the fire, and the inevitible flooding of air and oxygen into the enclosure tends to flare-up the fire instantly and often to an extent that makes a standard fire extinguisher almost ineffective, even if the operator can survive the heat and fire of the flareup.

It is at this moment of flare-up that the fire can spread to other parts of the boat, and can, surprisingly quickly, destroy it. The mandatory life preservers on board will save the passengers—although they may be burned—but cannot be of any help to the boat.

OBJECT OF THE INVENTION

It is therefore an object of this invention to provide a permanent access port to an engine compartment that is normally closed, and is just large enough to quickly and easily admit the nozzle of a standard fire extinguisher into the engine compartment to extinguish a fire, or the threat of a fire, without admitting enough oxygen into the compartment to fuel the fire and flames. It is a further object of this invention to provide a fire port that can be fitted into the wall of an engine compartment at any convenient and accessible place, presumeably near a fire extinguisher, that is also easily accessible in any emergency.

SUMMARY OF THE INVENTION

These and other objects are accomplished by providing a small hollow device that can be mounted through the wall of an engine compartment, to provide a small opening into the engine compartment. It normally consists of an inner and an outer portion that fit together and can be bolted through the wall of the compartment. A stop, the size and shape of the opening of the device, is secured within the opening of the device by a flexible coupling that, normally, holds the stop in place to seal it against vapors escaping from the engine compart. However, the flexible coupling is resilient enough to allow the stop to be pushed open by the nozzle of a fire extinguisher to spray in fire extinguishing fluids with almost no admission of oxygen in the air to fuel the flames. Thus the fire can be extinguished while it is contained within the engine compartment, and without opening the large lids that would draw in air and oxygen to feed the fire.

DETAILED DESCRIPTION OF THE DRAWINGS

Figure 1:
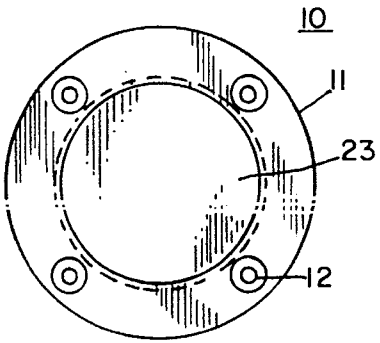
FIG. 1 is a top view of the device.
Figure 2:
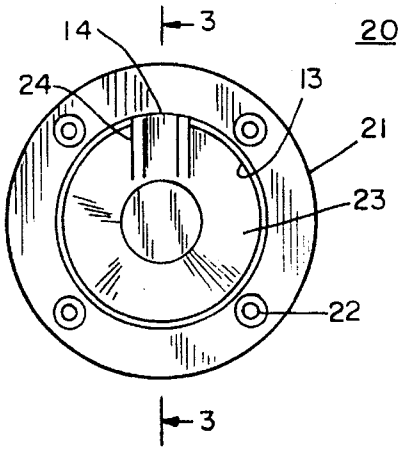
FIG. 2 is a bottom view of the device.

FIG. 1 shows a top view of an outside portion 10 of the device, which has a flange 11 to accommodate bolt holes, such as 12, to secure the outer portion 10 to the outside of the engine compartment or box and to an inner portion 20 that is seen, more clearly, in FIG. 2. A plug or stop 23 seals the opening through the device 10.

FIG. 2 shows a bottom view of the device with an inside portion 20, which has a flange 21 to accommodate bolt holes, such as 22, that are aligned with bolt holes 12 of the outside portion to secure it to the outer portion and to the inside of the engine box. This figure also shows an inner, hollow part 13 of the outer portion to fit between the flange 21 of the inner portion and its stop 23.

This tubular part 13 is open along 14 to permit stop 23 to be secured, in a flexible coupling, to the flange 21 of the inner portion. The inner portion is of a flexible plastic, in this species, so that the stop may be flexed open by the nozzle of a fire extinguisher, as will be shown in FIG. 4. The rigidity of the stop, and the degree of flexing of its coupling are controlled by flexible flanges 24, between the flange 21 and the stop 23, on either side of the opening 14 in the inner tubular part 13.

Figure 3:
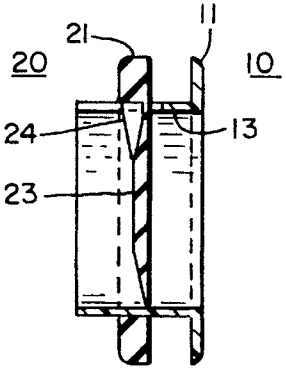
FIG. 3 is a side view of the device in cross section, along the lines 3—3 of FIG. 2.

FIG. 3 is a side view of the device, along the lines 3—3 of FIG. 2, in cross section. This clearly shows the inner portion 20 with its flange 21, and stop 23 fitted within the inner tubular part 13 of the outer portion 10. A flange 24 is also seen holding the stop in place. The outer portion 10 has its flange 11, supporting the inner, tubular part 13, to be secured to the inner flange 21.

Figure 4:
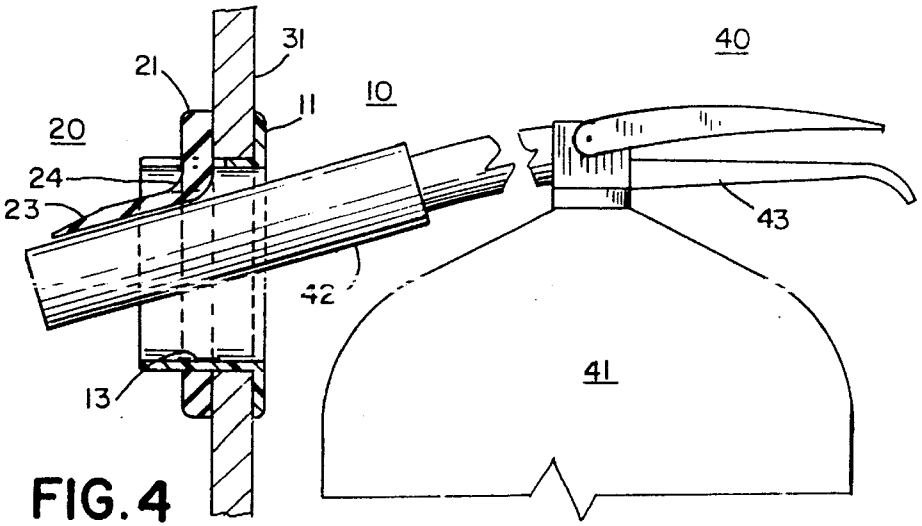
FIG. 4 is a side view of the device, similar to that of FIG. 3 partly in cross section, with a fire extinguisher in operating position.

FIG. 4 is another side view of the device in partial cross section and in operation. However, here the flange 11 of the outer portion rests against the outside of a wall 31 of the engine compartment, and the inner, hollow, tubular part 13 extends through, and within the engine compartment. The inner portion 20 has its flange 21 seated against the inside of the wall 31 of the engine compartment and is coupled to the flange of the outer portion by bolts, not shown, through the bolt holes 12 and 22 and the wall 31 of the engine compartment.

Here, however, the stop 23 is shown deflected inside the engine compartment by a nozzle 42, attached to a body 41, and actuated by a hand lever 43 of a fire extinguisher 40. The stop 23 flexes, along with the flange 24, to permit the entry of the nozzle.

The fire extinguisher may be of any standard type approved for marine use. Its size and shape would vary with the size of the engine and the engine compartment, and the needs of the boat. More than one may be available. The extinguisher would, presumably, be mounted very close to the fire port. Advice and instructions as to the use of the fire port might well be mounted close by.

The size and shape of this device, and particularly of the tubular part 13, could vary with the size and shape of standard fire extinguisher nozzles. It need not be circular, as shown. It could be more rectangular, as long as its width is greater than the diameter of a standard nozzle. The corresponding plug 23 would still be hinged at the top 14, and a longer stop would be easier to flex for entrance of a fire extinguisher nozzle. However, the circular shape lends itself to conventional molding techniques, and for cutting a hole in an existing wall for mounting in an engine compartment wall.

Actually, the stop 23 could be molded into the outer portion, or even be a separate entity, as long as it seals the small opening through the engine compartment wall, while providing an instant entrance into the engine compartment, for the fire extinguisher nozzle.

In practice, it would be a good idea to mount a thermostat—or even a smoke detector—to the fire port, or within the engine box to sound an alarm, when heat or smoke starts to build up within the engine compartment. This would warn that the engine should be turned off and that the fire extinguisher nozzle should be put through the fire port to extinguish any possible fire before opening the engine compartment.

I claim:

1. A fire port for a nozzle of a fire extinguisher leading into an engine compartment comprising: a hollow device mounted on and extending through a wall of said engine compartment; means for securing said hollow device to said wall; a stop fitted within said hollow device to seal said hollow device and said engine compartment; and means for connecting a top of said stop to a top of said hollow device by a resilient coupling comprising: an inner flange surrounding said hollow device, and means for connecting an upper portion of said inner flange to said top of said stop, said fire port having a gap along an upper portion of said hollow device to permit said means for connecting said upper portion of said inner flange to said top of said stop to move along inside and outside of said hollow device, and said resilient coupling holding said stop in a position to seal said hollow device, but can flex enough to open said stop when said nozzle of said fire extinguisher is pushed against it to put out any kind of a fire in said engine compartment without having to open any lid of said engine compartment, which would cause substantial introduction of air and oxygen, that would feed said fire.

* * * * *